US011577289B2

(12) United States Patent
Chen et al.

(10) Patent No.: US 11,577,289 B2
(45) Date of Patent: Feb. 14, 2023

(54) ANNULAR COOLING DEVICE FOR LARGE-SCALE CYLINDRICAL SHELL

(71) Applicant: Yanshan University, Qinhuangdao (CN)

(72) Inventors: Suwen Chen, Qinhuangdao (CN); Xingxing Yuan, Qinhuangdao (CN); Jie Li, Qinhuangdao (CN); Hongxuan Qin, Qinhuangdao (CN)

(73) Assignee: YANSHAN UNIVERSITY, Qinhuangdao (CN)

( * ) Notice: Subject to any disclaimer, the term of this patent is extended or adjusted under 35 U.S.C. 154(b) by 117 days.

(21) Appl. No.: 17/146,526

(22) Filed: Jan. 12, 2021

(65) Prior Publication Data

US 2021/0213502 A1 Jul. 15, 2021

(30) Foreign Application Priority Data

Jan. 15, 2020 (CN) ..... 202010041415.9

(51) Int. Cl.
*B21B 45/02* (2006.01)
*B21B 27/10* (2006.01)

(52) U.S. Cl.
CPC ..... *B21B 45/0233* (2013.01); *B21B 45/0218* (2013.01); *B21B 2027/103* (2013.01); *B21B 2045/0227* (2013.01); *B21B 2261/20* (2013.01)

(58) Field of Classification Search
CPC . B21B 17/14; B21B 45/0215; B21B 45/0218; B21B 2045/227; B21B 45/0233;
(Continued)

(56) References Cited

U.S. PATENT DOCUMENTS 3,294,599 A * 12/1966 Huseby ..... C21D 1/667 148/590
3,656,330 A * 4/1972 Brown ..... B05B 15/68 72/236

(Continued)

FOREIGN PATENT DOCUMENTS

CN 102847732 A 1/2013
CN 108118128 A 6/2018

(Continued)

OTHER PUBLICATIONS

Translation JP57-175009A; Bando et al., Oct. 1982.*
Translation CN102847732A, Yanshan, Jan. 2013.*

*Primary Examiner* — Edward T Tolan
(74) *Attorney, Agent, or Firm* — IPro, PLLC; Na Xu

(57) ABSTRACT

The present invention discloses an annular cooling device for large-scale cylindrical shell, which comprises a plurality of inner jet devices and outer jet devices; the inner jet devices are arranged inside the cylindrical shell along the inner periphery; the outer jet devices are arranged outside the cylindrical shell along the outer periphery; each inner jet device and each outer jet device are oppositely arranged; the inner jet devices are used for spraying cooling medium to the inner wall of the cylindrical shell; the outer jet devices are used for spraying the cooling medium to the outer wall of the cylindrical shell; and the spray ranges of each inner jet device and each outer jet device in the axial direction of the cylindrical shell are both greater than the length of the cylindrical shell.

6 Claims, 3 Drawing Sheets

(58) Field of Classification Search
CPC .. B21B 2045/0227; B21H 1/06; C21D 1/667; C21D 9/085
See application file for complete search history.

(56) References Cited

U.S. PATENT DOCUMENTS

| | | | | | |
|---|---|---|---|---|---|
| 3,998,084 | A * | 12/1976 | Rerecich | B21B 45/0218 | 72/201 |
| 4,502,669 | A * | 3/1985 | Heine, Jr. | C21D 1/667 | 266/259 |
| 5,212,975 | A * | 5/1993 | Ginzburg | B21B 27/10 | 72/236 |
| 5,697,169 | A * | 12/1997 | Jacob | B21B 45/0233 | 34/232 |
| 2009/0183805 | A1* | 7/2009 | Osako | C21D 1/667 | 148/590 |
| 2012/0017662 | A1* | 1/2012 | Sendai | B21B 23/00 | 72/69 |
| 2016/0101451 | A1* | 4/2016 | Schroeder | B21B 37/74 | 72/201 |

FOREIGN PATENT DOCUMENTS

| | | | | | |
|---|---|---|---|---|---|
| CN | 109663824 | A | | 4/2019 | |
| JP | 57-175009 | A | * | 10/1982 | B21B 19/14 |

* cited by examiner

ANNULAR COOLING DEVICE FOR LARGE-SCALE CYLINDRICAL SHELL

TECHNICAL FIELD

The present invention relates to the technical field of iron and steel metallurgical cooling, in particular to an annular cooling device for large-scale cylindrical shell.

BACKGROUND TECHNOLOGY

An important process of large-scale cylindrical shell rolling is that reasonable cooling is required during hot rolling. The new process of controlled cooling is a key process step to ensure the functional performance of large-scale cylindrical shell products. As an extra-large and thick piece, the large-scale cylindrical shell can reach a maximum size of 8 m in diameter, 0.65 m in thickness and 3.7 m in axial width. At present, the cooling of large-scale cylindrical shells usually only uses a set of cooling spray cooling units, with outer sprays cooling the outer surface of the cylindrical shell and inner sprays cooling the inner surface of the cylindrical shell. The existing ring rolling cooling method for large-scale cylindrical shells is one cooling process for each ring rolling, two cooling processes for ring rolling twice, and the interval between the two cooling processes is relatively long. This cooling method is relatively simple, however, the problem of internal grain growth during the cooling process of the cylindrical shell occurs inevitably. During hot rolling, the heat in the core of the cylindrical shell is high. After the surface is cooled, the heat in the core reverses to the surface. The thicker the wall, the stronger the effect of the core reversing to the surface and the faster the trend of grain growth. Mechanical properties such as strength, hardness, plasticity and toughness will decrease. Due to the effect of its own thickness, it is difficult for the cylindrical shell to meet the conditions of large deformation and high cooling rate, etc. Therefore, the reasonable choice of cooling process and the reasonable arrangement of the cooling device are the key to ensure the solving of the problems that occur during the cooling process of the large-scale cylindrical shell such as untimely cooling, unable to better inhibit the strong temperature reversion of the large and thick piece of the cylindrical shell and the deterioration of the mechanical properties of the grain growth.

Chinese Patent Publication No. CN107560443A "a cooling device for metallurgy" discloses a cooling device, which uses water jets to cool the upper and lower parts of the material to achieve uniform cooling. This method has a certain effect on the uniform cooling of the surface, but the cooling rate is not very obvious. Spray cooling is an effective heat transfer method, but generally affected by the arrangement of the tube bundle and the cross section and structure of the tube bundle. Tube bundle cooling water flow is presented as columns of water, the plate directly below the water column dissipates heat quickly, and the heat dissipation area between the water columns is relatively small, which can be solved by increasing the water flow, but this obviously increases the consumption of water energy, not in line with the modern society's energy-saving advocacy, so when this spray cooling is applied to thick and extra-thick pieces, the cooling rate is not ideal, i.e., the effect of inhibiting temperature reversion is not ideal.

SUMMARY OF THE INVENTION

The purpose of the present invention is to provide an annular cooling device for large-scale cylindrical shell to solve the above-mentioned problems in the prior art, so that the cylindrical shell is cooled while rolling, and cooling devices are provided inside and outside the cylindrical shell, which can cool the cylindrical shell timely during rolling to achieve the effect of inhibiting the temperature reversion.

To achieve the above purpose, the present invention provides the following solutions:

The present invention provides an annular cooling device for large-scale cylindrical shell, comprising a plurality of inner jet devices and a plurality of outer jet devices, wherein the plurality of inner jet devices are arranged inside the cylindrical shell along an inner circumference of the cylindrical shell, and the plurality of outer jet devices are arranged outside the cylindrical shell along an outer circumference of the cylindrical shell, each of the inner jet devices and each of the outer jet devices are arranged opposite to each other, and the plurality of inner jet devices are used to spray cooling medium to an inner wall of the cylindrical shell, and the plurality of outer jet devices are used to spray cooling medium to an outer wall of the cylindrical shell, spray range of each of the inner jet devices and each of the outer jet devices along the axial direction of the cylindrical shell is greater than the length of the cylindrical shell, the cylindrical shell is provided with a rolling device for rolling the cylindrical shell.

Preferably, each of the inner jet devices and each of the outer jet devices includes a plurality of sets of jet cooling devices, and each set of the jet cooling devices includes a cooling medium conveying device, a first fixing plate, a second fixing plate, a hydraulic cylinder and a plurality of jet pipes, a piston rod of the hydraulic cylinder is fixedly connected with the cooling medium conveying device; the cooling medium conveying device is in communication with the plurality of jet pipes through pipelines, the first fixing plate and the second fixing plate are sleeved on the plurality of jet pipes, and the first fixing plate and the second fixing plate are arranged in parallel.

Preferably, each set of the jet cooling devices are arranged in parallel, and each set of the jet cooling devices includes two rows of jet pipe sets arranged in parallel, and each row of the jet pipe sets includes a plurality of the jet pipes evenly distributed along the axial direction of the cylindrical shell.

Preferably, the plurality of the jet pipes of the two rows of jet pipe sets are arranged alternately, and one jet pipe in one row of the jet pipe sets is facing a center position of two adjacent jet pipes in the other row of the jet pipe sets, and each of the jet pipes is arranged obliquely, contact points of cooling medium sprayed from each of the jet pipes in each set of the jet cooling devices and the cylindrical shell are all located on a same straight line and form cooling lines, and each of the cooling lines is parallel to the axis of the cylindrical shell.

Preferably, the cylindrical shell is provided with a rolling device, the rolling device includes an upper roller, a lower roller, a first guide roller and a second guide roller, the upper roller is arranged inside the cylindrical shell and is in contact with the inner wall of the cylindrical shell, the lower roller, the first guide roller and the second guide roller are arranged outside the cylindrical shell and are in contact with the outer wall of the cylindrical shell, the upper roller and the lower roller are arranged opposite to each other, the plurality of inner jet devices and the upper roller are evenly distributed along the inner circumference of the cylindrical shell, and the plurality of outer jet devices and the lower roller are evenly distributed along the outer circumference of the cylindrical shell, the first guide roller and the second guide roller are located on both sides of the lower roller, and the first guide roller is located between the lower roller and the outer jet device adjacent on one side, the second guide roller is located between the lower roller and the outer jet device adjacent on the other side.

Preferably, an included angle between the inner jet devices on both sides of the upper roller and an included angle between the outer jet devices on both sides of the lower roller are both:

$$2A = 2 * \frac{360}{N+1}$$

included angles between each of remaining adjacent inner jet devices and included angles between each of remaining adjacent outer jet devices are:

$$A = \frac{360}{N+1}$$

where, N is the number of the inner jet device and the outer jet device.

Preferably, the cooling medium conveying device includes a plurality of main pipes, each of the main pipes is in communication with an external cooling medium source and each of the main pipes is provided with a jet pump; the number of the main pipes is the same as the number of the jet pipe sets, each of the main pipes is in communication with a plurality of branch pipes, the number of the branch pipes on each of the main pipes is the same as the number of the jet pipes in each row, and the branch pipes on each of the main pipes are in communication with each row of jet pipes respectively.

Preferably, the cooling lines formed by the jet pipe sets in the inner jet device are arranged opposite to the cooling lines formed by the jet pipe sets in the outer jet device.

The present invention achieves the following technical effects relative to the prior art:

The annular cooling device for large-scale cylindrical shell of the present invention is provided with a plurality of inner jet devices and outer jet devices along the inner and outer sides of the cylindrical shell, so that the cylindrical shell is cooled while rolling during the rolling process, which can ensure timely cooling during the rolling of the cylindrical shell, and both the inner jet device and the outer jet device use the jet method to cool the cylindrical shell. The cooling medium spray range of the inner jet device and the outer jet device is greater than the length of the cylindrical shell, so that the inner and outer surfaces of the cylindrical shell can be completely cooled to achieve the effect of inhibiting the temperature reversion.

DESCRIPTION OF THE DRAWINGS

In order to more clearly illustrate the technical solutions in the embodiments of the present invention or in the prior art, the following drawings are briefly described for use in the embodiments, and it is clear that the drawings in the following description are only some embodiments of the present invention, and other drawings can be obtained from these drawings without creative efforts for a person of ordinary skill in the art.

Where: 1—cylindrical shell, 2—cooling medium conveying device, 3—first fixing plate, 4—second fixing plate, 5—hydraulic cylinder, 6—jet pipe, 7—upper roller, 8—lower roller, 9—first guide roller, 10—second guide roller, 11—main pipe, 12—branch pipe, 13—inner jet device, 14—outer jet device.

DETAILED DESCRIPTION

The technical solutions in the embodiments of the present invention will be clearly and completely described below in conjunction with the accompanying drawings in the embodiments of the present invention, and it is clear that the described embodiments are only a part of the embodiments of the present invention, rather than all the embodiments. Based on the embodiments of the present invention, all other embodiments obtained by those of ordinary skill in the art without creative efforts shall fall within the protection scope of the present invention.

The purpose of the present invention is to provide an annular cooling device for large-scale cylindrical shell to solve the above-mentioned problems in the prior art, so that the cylindrical shell is cooled while rolling, and cooling devices are provided inside and outside the cylindrical shell, which can cool the cylindrical shell timely during rolling to achieve the effect of inhibiting the temperature reversion.

In order to make the above purpose, features and advantages of the present invention more comprehensible, the present invention will be further described in detail below in conjunction with the accompanying drawings and specific embodiments.

Figure 1:
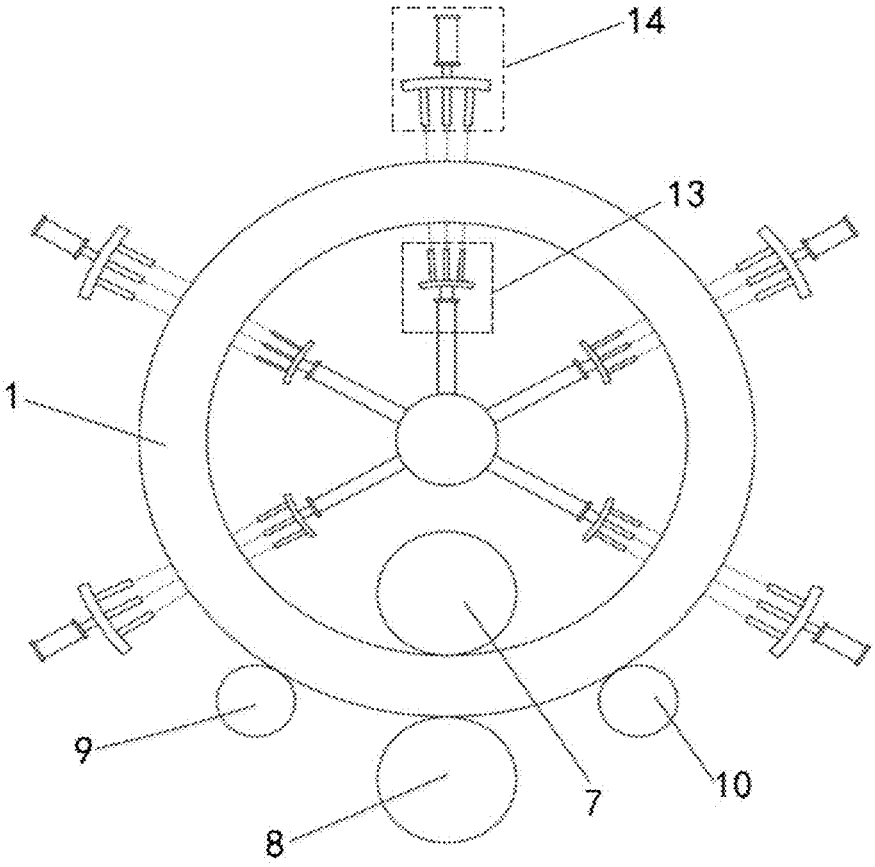
FIG. 1 is a schematic view of the annular cooling device for large-scale cylindrical shell of the present invention.
Figure 2:
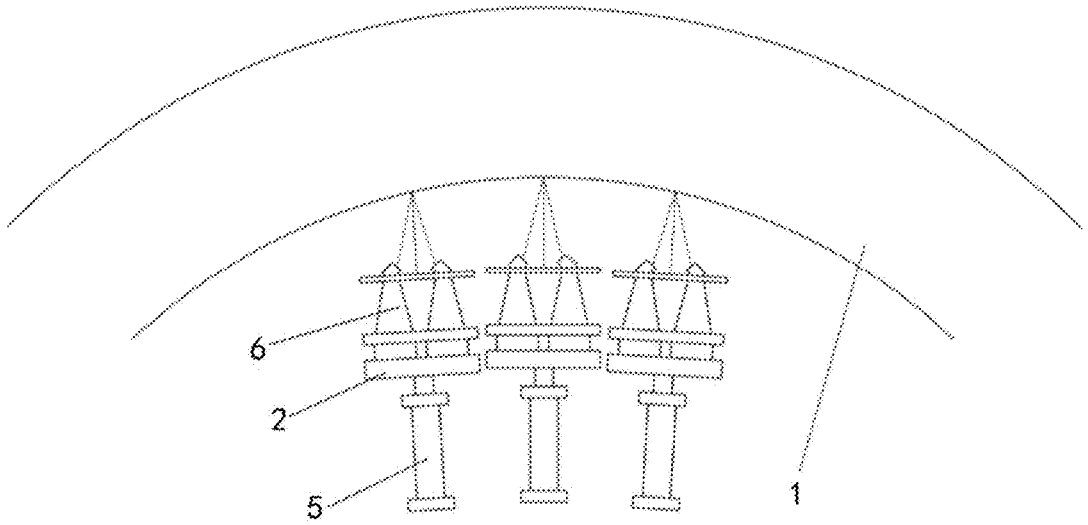
FIG. 2 is a schematic view of the jet cooling device of the inner jet device in the present invention (cooling the inner surface of the cylindrical shell)
Figure 3:
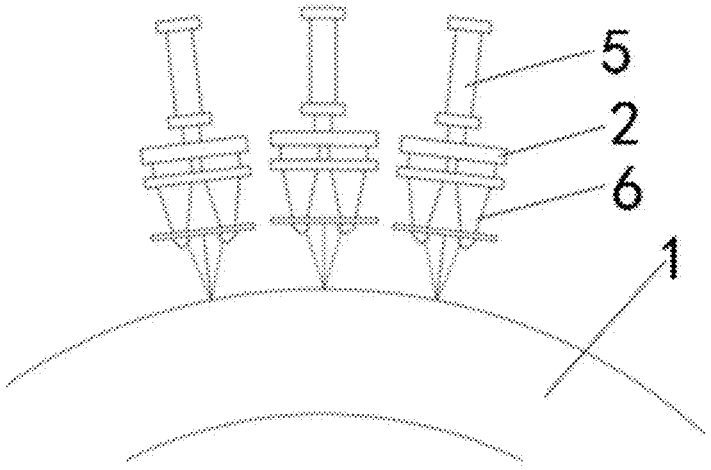
FIG. 3 is a schematic view of the jet cooling device of the outer jet device in the present invention (cooling the outer surface of the cylindrical shell)
Figure 4:
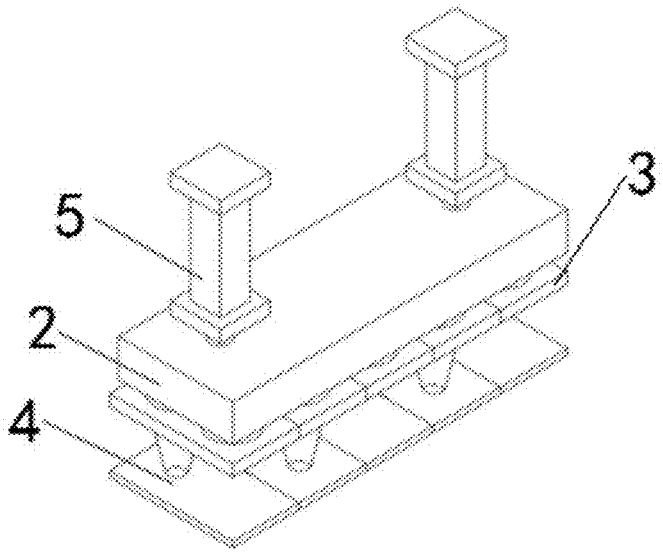
FIG. 4 is a perspective view of the jet cooling device in the present invention.
Figure 5:
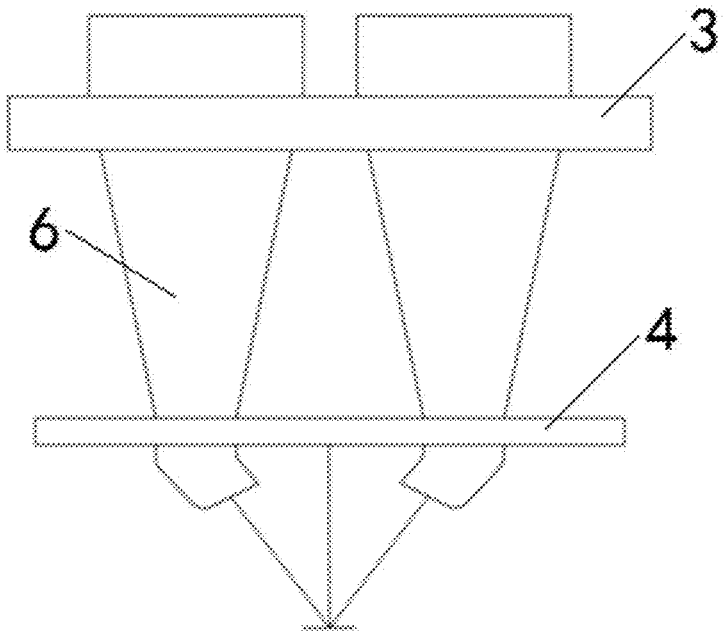
FIG. 5 is a schematic view of the jet pipe in the present invention.
Figure 6:
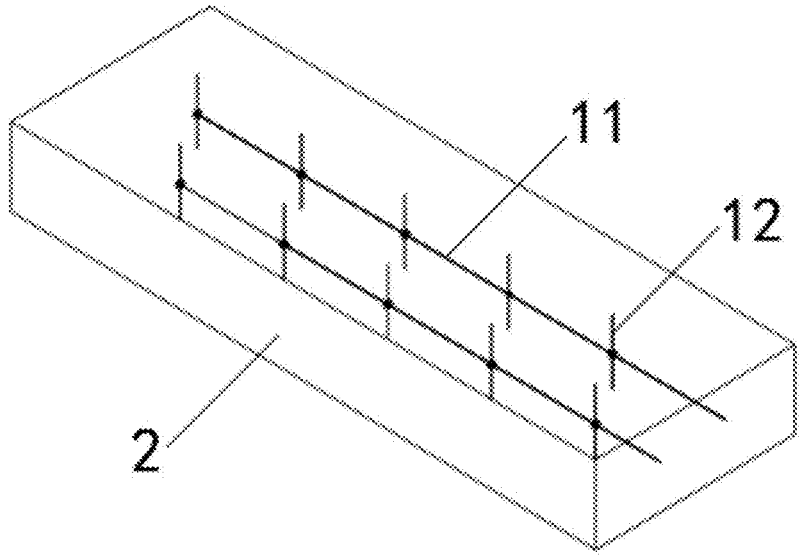
FIG. 6 is a schematic view of the cooling medium conveying device in the present invention.

As shown in FIG. 1 to FIG. 6: this embodiment provides an annular cooling device for large-scale cylindrical shell, which includes a plurality of inner jet devices 13 and a plurality of outer jet devices 14, and the plurality of inner jet devices 13 are arranged inside the cylindrical shell 1 along the inner circumference of the cylindrical shell 1, the plurality of outer jet devices 14 are arranged outside the cylindrical shell 1 along the outer circumference of the cylindrical shell 1. The inner jet devices 13 and the outer jet devices 14 are arranged opposite to each other. The plurality of inner jet devices 13 are used to spray the cooling medium to the inner wall of the cylindrical shell 1, and the plurality of outer jet devices 14 are used to spray the cooling medium to the outer wall of the cylindrical shell 1. The spray range of each inner jet device 13 and each outer jet device 14 along the axial direction of the cylindrical shell 1 is greater than the length of the cylindrical shell 1, and the length of the cylindrical shell 1 refers to the length of the cylindrical shell 1 along the axial direction. The cylindrical shell 1 is provided with a rolling device for rolling the cylindrical shell 1. The annular cooling device for large-scale cylindrical shell of this embodiment is provided with a plurality of inner jet devices 13 and a plurality of outer jet devices 14 along the inner and outer sides of the cylindrical shell 1, so that the cylindrical shell 1 is cooled while rolling during the rolling process, which can ensure timely cooling of the cylindrical shell 1 during rolling, and both the inner jet device 13 and the outer jet device 14 use the jet method to cool the cylindrical shell 1, so that the inner and outer surfaces of the cylindrical shell 1 can be completely cooled to achieve the effect of inhibiting the temperature reversion.

In this embodiment, each of the inner jet devices 13 and each of the outer jet devices 14 includes a plurality of sets of jet cooling devices, preferably three sets of jet cooling devices, and each set of jet cooling devices includes a cooling medium conveying device 2, a first fixing plate 3, a second fixing plate 4, a hydraulic cylinder 5 and a plurality of jet pipes 6, the piston rod of the hydraulic cylinder 5 is fixedly connected with the cooling medium conveying device 2. The hydraulic cylinder 5 of this embodiment enables each inner jet device 13 and each outer jet device 14 to be adjusted along the radial direction of the cylindrical shell 1, and flexibly adjust the distance between the jet cooling medium and the inner and outer surfaces of the cylindrical shell 1, which not only can achieve uniform and rapid cooling of the inner and outer walls of the cylindrical shell 1, but also increase the utilization rate of the cooling medium, which can achieve cooling of the cylindrical shells 1 with different diameters and different thicknesses, and the radial adjustment of the cooling equipment is achieved by hydraulic cylinders 5. In this embodiment, each set of jet cooling devices is provided with two hydraulic cylinders 5, both of which are fixed on the cooling medium conveying device 2; the cooling medium conveying device 2 is in communication with the plurality of jet pipes 6 through pipelines, the first fixing plate 3 and the second fixing plate 4 are sleeved on the plurality of jet pipes 6, and the first fixing plate 3 and the second fixing plate 4 are arranged in parallel. The first fixing plate 3 is located above the second fixing plate 4. The first fixing plate 3 and the second fixing plate 4 are used to fix the jet pipes 6, so that the jet pipes 6 maintain a relatively stable position during the process of spraying the cooling medium.

In this embodiment, each set of jet cooling devices are arranged in parallel, and each set of jet cooling devices includes two rows of jet pipe sets arranged in parallel, and each row of jet pipe sets includes a plurality of jet pipes 6 evenly distributed along the axial direction of the cylindrical shell 1. The number of jet pipes 6 in each row of jet pipe sets is set according to the actual length of the cylindrical shell 1 to ensure that the cooling medium spray range of the inner jet device 13 and the outer jet device 14 is greater than the length of the cylindrical shell 1.

In this embodiment, the plurality of jet pipes 6 of the two rows of jet pipe sets are arranged alternately, and one jet pipe 6 in one row of jet pipe sets is facing the center position of two adjacent jet pipes 6 in the other row of jet pipe sets, i.e., three adjacent jet pipes form an isosceles triangle, and each of the jet pipes 6 is arranged obliquely. The contact points of the cooling medium sprayed from each of the jet pipes 6 in each set of jet cooling devices and the cylindrical shell 1 are all located on the same straight line and form cooling lines, and each of the cooling lines is parallel to the axis of the cylindrical shell 1.

In this embodiment, the cooling medium is preferably cooling water.

In this embodiment, the rolling device includes an upper roller 7, a lower roller 8, a first guide roller 9 and a second guide roller 10. The upper roller 7 is arranged inside the cylindrical shell 1 and is in contact with the inner wall of the cylindrical shell 1. The lower roller 8, the first guide roller 9 and the second guide roller 10 are arranged outside the cylindrical shell 1 and are in contact with the outer wall of the cylindrical shell 1. The upper roller 7 and the lower roller 8 are arranged opposite to each other. The plurality of inner jet devices 13 and the upper roller 7 are evenly distributed along the inner circumference of the cylindrical shell 1, and the plurality of outer jet devices 14 and the lower roller 8 are evenly distributed along the outer circumference of the cylindrical shell 1. The first guide roller 9 and the second guide roller 10 are located on both sides of the lower roller 8, and the first guide roller 9 is located between the lower roller 8 and the outer jet device 14 adjacent on one side, the second guide roller 10 is located between the lower roller 8 and the outer jet device 14 adjacent on the other side. The upper roller 7 and the lower roller 8 are used for rolling the cylindrical shell 1, and the first guide roller 9 and the second guide roller 10 play a guiding role.

In this embodiment, the cooling medium sprayed by the inner jet devices 13 on both sides of the rolling device impacts the inner surface of the cylindrical shell 1. The cooling medium is affected by gravity and gathers at the rolling position of the upper roll 7, which solves the problem of uneven cooling caused by the absence of a cooling device at the position of the rolling device.

In this embodiment, the included angle between the inner jet devices 13 on both sides of the upper roller 7 and the included angle between the outer jet devices 14 on both sides of the lower roller 8 are both:

$$2A = 2 * \frac{360}{N+1}$$

The included angles between each of the remaining adjacent inner jet devices 13 and the included angles between each of the remaining adjacent outer jet devices 14 are:

$$A = \frac{360}{N+1}$$

where, N is the number of the inner jet device 13 and the outer jet device 14.

In this embodiment, the number of the inner jet devices 13 and the number of the outer jet devices 14 are both preferably five, so that the included angle between the inner jet devices 13 on both sides of the upper roller 7 and between the outer jet device 14 on both sides of the lower roller 8 are all 120°, and the included angles between each of the remaining adjacent inner jet devices 13 and the included angles between each of the remaining adjacent outer jet devices 14 are all 60°.

In this embodiment, each set of jet cooling devices forms a cooling line, each inner jet device 13 and each outer jet device 14 form three cooling lines, and the inner surface and outer surface of the cylindrical shell 1 are each provided with fifteen cooling lines.

In this embodiment, the cooling medium conveying device 2 includes a plurality of main pipes 11, each of the main pipes 11 is in communication with an external cooling medium source and each of the main pipes 11 is provided with a jet pump. The number of main pipes 11 is the same as the number of the jet pipe sets. Each of the main pipes 11 is connected with a plurality of branch pipes 12, the number of branch pipes 12 on each of the main pipes 11 is the same as the number of jet pipes 6 in each row, and the branch pipes 12 on each of the main pipes 11 are in communication with each row of jet pipes 6 respectively, and the cooling medium source conveys the cooling medium to each branch pipe 12 through the main pipe 11. Under the action of the jet pump, the cooling medium is sprayed to the inner and outer walls of the cylindrical shell 1 through the jet pipe 6 to form cooling lines. During the rolling process of the cylindrical shell 1, the cooling lines complete the cooling effect on the cylindrical shell 1 as the cylindrical shell 1 is ring rolled. In this embodiment, the cooling lines formed by the jet pipe sets in the inner jet device 13 are arranged opposite to the cooling lines formed by the jet pipe sets in the outer jet device 14.

In this embodiment, the rolling parameters of the large-scale cylindrical shell are: the outer diameter (2*r*) of cylindrical shell 1 is 5334 mm, the circumferential speed (V) of cylindrical shell 1 is 150 mm/s, the thickness of cylindrical shell 1 is 586 mm, and the rolling temperature is 980° C., the length of cylindrical shell 1 is 2770 mm, according to the formula $V=2\pi r/T$, it can be known that the time for the cylindrical shell 1 is to rotate 60° is greater than 2 s, and the circumferential speed of the cylindrical shell 1 is determined by the upper roller 7 and the lower roller 8.

The cylindrical shell 1 is ring rolled under the action of the upper roller 7 and the lower roller 8, and the first guide roller 9 and the second guide roller 10 move outward as the diameter of the cylindrical shell 1 expands. The outer jet device 14 corresponds to the outer surface of the cylindrical shell 1, the inner jet device 13 corresponds to the inner surface of the cylindrical shell 1, the hydraulic cylinder 5 extends, and the inner jet device 13 and the outer jet device 14 are close to the inner and outer surfaces of the cylindrical shell 1. The combination of the inner jet device 13 and the outer jet device 14 of the cylindrical shell 1 starts working, and the cooling medium conveying device 2 supplies cooling medium to the inner jet device 13 and the outer jet device 14. It is measured that the heat transfer time from the core of the large-scale cylindrical shell to the outer surface is 1 s-2 s. When the rolling of cylindrical shell 1 starts, the circumferential speed of cylindrical shell 1 is 150 mm/s, the inner and outer surfaces of the cylindrical shell 1 are cooled by the cooling medium, and the heat transfer from the core to the surface, and the surface temperature quickly rises to the same temperature as before cooling. The time interval between two adjacent sets of inner jet devices 13 and outer jet devices 14 should be greater than 2 s. After the cylindrical shell 1 is cooled by the previous set of inner jet device 13 and outer jet device 14, it reaches the cooling device of the next set of inner jet device 13 and outer jet device 14, the surface temperature of the cylindrical shell 1 rises rapidly. When the surface temperature reaches the vicinity of the highest point, the next set of inner jet device 13 and outer jet device 14 come into play, and the temperature of the inner and outer surfaces of the cylindrical shell 1 is timely cooled.

With the annular cooling device for large-scale cylindrical shell of this embodiment, the cylindrical shell 1 will to be cooled multiple times per revolution, which can achieve timely cooling of the large-scale cylindrical shell, thereby inhibiting the temperature reversion, which can ensure the overall temperature uniformity of the cylindrical shell 1, solve the problem of internal grain growth due to temperature reversion during the cooling process of the cylindrical shell 1, the mechanical properties of the strength, hardness, plasticity and toughness of the steel material are guaranteed, and the cylindrical shell 1 is uniformly cooled at the same time in the length direction. The jet cooling method can well solve the problem of uneven cooling on the surface of the cylindrical shell 1, and will not hinder the heat dissipation on the surface of the cylindrical shell 1, effectively improving the utilization rate of water resources and reducing the load of the cooling system. The inner jet device 13 and the outer jet device 14 can be adjusted along the radial direction of the cylindrical shell 1 to realize cooling of the cylindrical shell 1 with different diameters and thicknesses.

In this specification, specific embodiments are used to describe the principle and implementation of the present invention. The description of the above embodiments is only used to help understand the method and core ideas of the present invention; at the same time, for those of ordinary skill in the art, there will be changes in the specific implementation and application scope based on the ideas of the present invention. In summary, the content of this specification should not be construed as a limitation of the present invention.

What is claimed is:

1. An annular cooling device for large-scale cylindrical shell, comprising a plurality of inner jet devices and a plurality of outer jet devices, wherein the plurality of inner jet devices are arranged inside the cylindrical shell along an inner circumference of the cylindrical shell, and the plurality of outer jet devices are arranged outside the cylindrical shell along an outer circumference of the cylindrical shell, each of the inner jet devices and each of the outer jet devices are arranged opposite to each other, and the plurality of inner jet devices are used to spray cooling medium to an inner wall of the cylindrical shell, and the plurality of outer jet devices are used to spray cooling medium to an outer wall of the cylindrical shell, spray range of each of the inner jet devices and each of the outer jet devices along the axial direction of the cylindrical shell is greater than the length of the cylindrical shell, the cylindrical shell is provided with a rolling device for rolling the cylindrical shell;

wherein each of the inner jet devices and each of the outer jet devices includes a plurality of sets of jet cooling devices, and each set of the jet cooling devices includes a cooling medium conveying device, a first fixing plate, a second fixing plate, a hydraulic cylinder and a plurality of jet pipes, a piston rod of the hydraulic cylinder is fixedly connected with the cooling medium conveying device; the cooling medium conveying device is in communication with the plurality of jet pipes through pipelines, the first fixing plate and the second fixing plate are sleeved on the plurality of jet pipes, and the first fixing plate and the second fixing plate are arranged in parallel;

wherein the rolling device includes an upper roller, a lower roller, a first guide roller and a second guide roller, the upper roller is arranged inside the cylindrical shell and is in contact with the inner wall of the cylindrical shell, the lower roller, the first guide roller and the second guide roller are arranged outside the cylindrical shell and are in contact with the outer wall of the cylindrical shell, the upper roller and the lower roller are arranged opposite to each other, the plurality of inner jet devices and the upper roller are evenly distributed along the inner circumference of the cylindrical shell, and the plurality of outer jet devices and the lower roller are evenly distributed along the outer circumference of the cylindrical shell, the first guide roller and the second guide roller are located on both sides of the lower roller, and the first guide roller is located between the lower roller and the outer jet device adjacent on one side, the second guide roller is located between the lower roller and the outer jet device adjacent on the other side.

2. The annular cooling device for large-scale cylindrical shell according to claim 1, wherein each set of the jet cooling devices are arranged in parallel, and each set of the jet cooling devices includes two rows of jet pipe sets arranged in parallel, and each row of the jet pipe sets includes a plurality of the jet pipes evenly distributed along the axial direction of the cylindrical shell.

3. The annular cooling device for large-scale cylindrical shell according to claim 2, wherein the plurality of the jet pipes of the two rows of jet pipe sets are arranged alternately, and one jet pipe in one row of the jet pipe sets is facing a center position of two adjacent jet pipes in the other row of the jet pipe sets, and each of the jet pipes is arranged obliquely, contact points of cooling medium sprayed from each of the jet pipes in each set of the jet cooling devices and the cylindrical shell are all located on a same straight line and form cooling lines, and each of the cooling lines is parallel to the axis of the cylindrical shell.

4. The annular cooling device for large-scale cylindrical shell according to claim 1, wherein an included angle between the inner jet devices on both sides of the upper roller and an included angle between the outer jet devices on both sides of the lower roller are both:

$$2A = 2 * \frac{360}{N+1}$$

included angles between each of remaining adjacent inner jet devices and included angles between each of remaining adjacent outer jet devices are:

$$A = \frac{360}{N+1}$$

where, N is the number of the inner jet device and the outer jet device.

5. The annular cooling device for large-scale cylindrical shell according to claim 2, wherein the cooling medium conveying device includes a plurality of main pipes, each of the main pipes is in communication with an external cooling medium source and each of the main pipes is provided with a jet pump; the number of the main pipes is the same as the number of the jet pipe sets, each of the main pipes is in communication with a plurality of branch pipes, the number of the branch pipes on each of the main pipes is the same as the number of the jet pipes in each row, and the branch pipes on each of the main pipes are in communication with each row of jet pipes respectively.

6. The annular cooling device for large-scale cylindrical shell according to claim 3, wherein the cooling lines formed by the jet pipe sets in the inner jet device are arranged opposite to the cooling lines formed by the jet pipe sets in the outer jet device.

* * * * *